US008225685B2

(12) United States Patent
Heichel et al.

(10) Patent No.: US 8,225,685 B2
(45) Date of Patent: Jul. 24, 2012

(54) VIBRATION GENERATOR

(75) Inventors: Christian Heichel, Niedernberg (DE); Albrecht Kleibl, Schaafsheim (DE)

(73) Assignee: ABI Anlagentechnik-Baumaschinen-Industriebedarf Maschinenfabrik und Vertriebsgesellschaft mbH, Niedernberg (DE)

( * ) Notice: Subject to any disclaimer, the term of this patent is extended or adjusted under 35 U.S.C. 154(b) by 557 days.

(21) Appl. No.: 12/459,692

(22) Filed: Jul. 7, 2009

(65) Prior Publication Data

US 2010/0050795 A1 Mar. 4, 2010

(30) Foreign Application Priority Data

Aug. 27, 2008 (EP) ..... 08015096

(51) Int. Cl.
*F16H 33/00* (2006.01)

(52) U.S. Cl. ..... 74/61

(58) Field of Classification Search ..... 74/61, 87; 310/76, 77, 81, 92, 93
See application file for complete search history.

(56) References Cited

U.S. PATENT DOCUMENTS

| | | | | |
|---|---|---|---|---|
| 3,433,311 | A * | 3/1969 | Lebelle | 173/49 |
| 3,564,932 | A * | 2/1971 | Lebelle | 74/61 |
| 3,837,231 | A * | 9/1974 | Holmlund | 74/61 |
| 4,113,034 | A * | 9/1978 | Carlson | 173/49 |
| 5,177,386 | A * | 1/1993 | Shimada | 310/81 |
| 5,253,542 | A * | 10/1993 | Houze | 74/61 |
| 5,410,879 | A * | 5/1995 | Houze | 60/469 |
| 6,345,546 | B1 * | 2/2002 | Houze | 74/61 |
| 6,604,583 | B1 * | 8/2003 | Van Randen | 173/49 |

FOREIGN PATENT DOCUMENTS

DE 20 2007 006 283 12/2007

* cited by examiner

*Primary Examiner* — Thomas R Hannon
*Assistant Examiner* — Phillip A Johnson
(74) *Attorney, Agent, or Firm* — Collard & Roe, P.C.

(57) ABSTRACT

A vibration generator has at least two shaft groups, on which at least two imbalance groups are disposed, and which are connected with at least one drive by means of which they are put into rotation. The shaft groups are connected with the at least one drive so that the speed of rotation of one shaft group amounts to a multiple of at least one other shaft group, and the shaft groups demonstrate a significantly different static moment with regard to one another. At least one of the shaft groups is connected with a phase shifter, by way of which the static moment of the shaft group can be adjusted.

14 Claims, 6 Drawing Sheets

VIBRATION GENERATOR

CROSS REFERENCE TO RELATED APPLICATIONS

Applicants claim priority under 35 U.S.C. §119 of European Application No. 08015096.4 filed Aug. 27, 2008.

BACKGROUND OF THE INVENTION

1. Field of the Invention

The invention relates to a vibration generator.

2. The Prior Art

In construction, vibration generators are used to introduce objects, for example profiles, into the ground, or to draw them from the ground, or also to compact ground material. The ground is excited by means of vibration, and thereby achieves a "pseudo-fluid" state. The goods to be driven in can then be pressed into the construction ground by a static top load. The vibration is characterized by a linear movement and is generated by rotating imbalances that run in opposite directions, in pairs, within a vibrator drive.

Vibration generators are vibration exciters having a linear effect, whose centrifugal force is generated by rotating imbalances. These vibration exciters move at a changeable speed. The size of the imbalance is also referred to as static moment. The progression of the speed of the linear vibration exciter corresponds to a periodically recurring function, particularly a sine function. On the basis of the sine-shaped progression of the force effect generated by the rotating imbalance masses, a drive that acts alternately in the forward drive direction and counter to it, with time offset, is produced. This effect is determined, in the final analysis, by static forces, particularly the inherent weight and static top loads. Without the superimposition of static forces on the vibration, the material being driven would not move forward, but rather simply vibrate back and forth.

The pile-driving process, with the aforementioned sine-shaped force progression, demonstrates significant energy consumption, which is additionally increased due to friction of the material being driven in the ground. The energy expended for the vibration generator brings about practically no forward drive. To eliminate this problem, it was proposed to couple multiple groups of imbalance masses that rotate at different speeds of rotation. The force progression of each imbalance group describes a sine curve. Addition of the individual force progressions, in total, yields a progression in which the amounts of the amplitude in the direction in which the forces are superimposed are greater than the amounts of the amplitudes in the opposite direction. This solution brings about a significant forward drive, thereby increasing the efficiency of the pile-driving process. However, the degree of efficiency is dependent on the speed of rotation required in each instance, on the mass of the goods being driven, on the construction method, and on the ground conditions. In order to be able to better utilize the available drive power and to limit the vibrations generated in the ground, a device is required that allows a simple change in the resulting static moment of at least one shaft group.

SUMMARY OF THE INVENTION

It is therefore an object of the invention to provide a vibration generator having a directed force effect in the forward drive direction, in which a change in the resulting static moment of at least one shaft group is made possible even during operation. According to the invention, this task is accomplished by means of a vibration generator comprising at least two shaft groups, on which at least two imbalance groups are disposed. The shaft groups are connected with at least one drive by means of which they are put into rotation. The shaft groups are connected with the at least one drive in such a manner that the speed of rotation of one shaft group amounts to a multiple of another shaft group, and that at least two of the shaft groups provided with the imbalance masses demonstrate a significantly different static moment with regard to one another. At least one shaft group is connected with a phase shifter, by way of which the static moment of the shaft group can be adjusted.

With the invention, a vibration generator having a directed force effect in the forward drive direction is created, in which a change in the resulting moment of at least one shaft group is made possible even during operation.

In the vibration generator according to the invention, there is the possibility of adjusting the static moment of the individual shaft groups independently of one another. In this way, the shape of the characteristic line of the vibration generator can be adapted to an individual case. One and the same vibration generator can thus generate different frequencies, at the same speed of rotation of the drive motors, by means of setting the static moment on different shaft groups to zero.

The term "phase shifter" in the following is understood to mean a device that is suitable for bringing about an adjustment in the relative position of two rotating objects (such as shafts or imbalances, for example) with regard to one another.

In the following, the term "imbalance group" refers to an arrangement of imbalances that are coupled with one another and disposed on at least two shafts that rotate in opposite directions, which imbalances rotate at the same speed of rotation.

In the following, the term "shaft group" refers to an arrangement of shafts that are constantly coupled with one another at the same speed of rotation relative to one another. Multiple imbalance groups can be disposed on one shaft group.

It is advantageous if the phase shifter is formed by a swivel motor. Use of a swivel motor allows a relative adjustment of the imbalance groups of one shaft group with regard to one another, without any conversion of a linear movement into a rotational movement being required, thereby achieving a compact construction.

Preferably, the swivel motor is a rotary vane swivel motor, having a swivel motor shaft and a swivel motor housing. Both the swivel motor shaft and the swivel motor housing are each connected with imbalances of at least one shaft group, and the rotational position of the swivel motor housing relative to the swivel motor shaft can be changed.

In a further development of the invention, the swivel motor has means for locking the swivel motor housing in place with the swivel motor shaft. A change in position due to internal leakage is prevented by the means for locking the swivel motor housing in place with the swivel motor shaft. Since the hydraulic pressure can be lowered in the locked state of the swivel motor housing, there is clearly less stress on the seals, and this results in a reduced wear on the seals, since in the pressure-free state, the press-down forces are clearly lower. Furthermore, an energy saving is brought about, since no adjustment or re-adjustment of the swivel motor is required over the period of operation of the vibrator. Furthermore, the required regulation of the swivel motor is simplified.

In an embodiment of the invention, the means for locking the swivel motor housing in place with the swivel motor shaft can be hydraulically activated. In this way, the braking system can be connected with the existing hydraulics.

Preferably, the means for locking the swivel motor housing in place with the swivel motor shaft are formed by a spring-pressure multi-disk brake. Such multi-disk brakes require only a small construction space.

In a further development of the invention, two shaft groups are disposed, on which at least two imbalance groups are disposed. The shaft groups are connected with the at least one drive in such a manner that the speed of rotation of the first shaft group amounts to half the speed of rotation of the second shaft group, and the ratio of the static moments of the shaft groups provided with the imbalance groups amounts to between six to one and ten to one. By coupling at least two shaft groups having a speed of rotation ratio of 2:1 and a ratio of the static moment of between 6:1 and 10:1, a directed characteristic line in the forward drive direction is produced by superimposition of the sine-shaped force characteristic lines generated by the rotating imbalances. A significantly greater maximal force in the forward drive direction comes about, in comparison with the opposite direction. Since the ground cannot follow the great acceleration in the pile-driving direction during the pile-driving process, the goods to be driven in uncouple from the ground, which is also vibrating, at every forward drive pulse. Because of this periodic uncoupling of ground and goods to be driven in, little energy is transferred to the construction ground. As a result, the vibration stress on the surroundings is also clearly reduced.

Preferably, the static moment of the first shaft group is eight times as great as the static moment of the second shaft group. In this way, a marked force peak in the forward drive direction is brought about.

In an alternative embodiment of the invention, three shaft groups are disposed, on which at least three imbalance groups are disposed. The shaft groups are connected with the at least one drive in such a manner that the speed of rotation of the first shaft group amounts to half the speed of rotation of the second shaft group and a third of the speed of rotation of the third shaft group, and wherein the ratio of the static moments of the shaft groups provided with the imbalance groups, relative to one another, amounts to substantially 100:16.64:3.68. In this way, the maximally acting force is increased by a further marked force peak in the forward drive direction, thereby bringing about a further increase in energy efficiency, connected with acceleration of the pile-driving process.

In another alternative embodiment of the invention, four shaft groups are disposed, on which at least four imbalance groups are disposed, whereby the shaft groups are connected with the at least one drive in such a manner that the ratio of the speeds of rotation of the shaft groups, relative to one another, amounts to substantially 1:2:3:4, and that the ratio of the static moments of the shaft groups provided with the imbalance groups, relative to one another, amounts to substantially 100:18.72:5.6:1.38. In this way, a further intensification of the force progression in the forward drive direction is achieved.

In a further development of the invention, there are means for adjusting the direction of effect of the vibration generator. In this way, adaptation of the vibration generator to different process requirements, such as pile-driving and retraction, is possible.

In an embodiment of the invention, the means for adjustment of the effect direction comprise a phase shifter by way of which the relative position of at least two imbalance groups, with regard to one another, can be changed in operation. In this way, a change in the effect direction is made possible, without any conversion measures being required. Preferably, the phase shifter is formed by a swivel motor.

In a further embodiment of the invention, the at least two shaft groups are connected with the swivel motor by way of gear wheels. An imbalance group is connected with the stator, and a shaft group is connected with the rotor of the swivel motor. In this way, direct adjustment of the shaft groups by way of the swivel motor is made possible.

It is advantageous if the swivel motor is a rotary vane swivel motor that has multiple vanes. This is characterized, as compared with swivel motors that have one vane, by torque that is many times greater and by lower friction.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Referring now in detail to the drawings, the vibration generators selected as exemplary embodiments are configured as vibrator gear mechanisms. Such vibrators substantially consist of a housing in which shafts provided with gear wheels are mounted. The gear wheels are each provided with imbalance masses. Such vibrator gear mechanisms with imbalance masses mounted so as to rotate are known to a person skilled in the art, for example from German Patent Application No. DE 20 2007 006 283 U1. The following explanation of the exemplary embodiments is substantially limited to the arrangement of shafts and imbalance masses.

Figure 1:
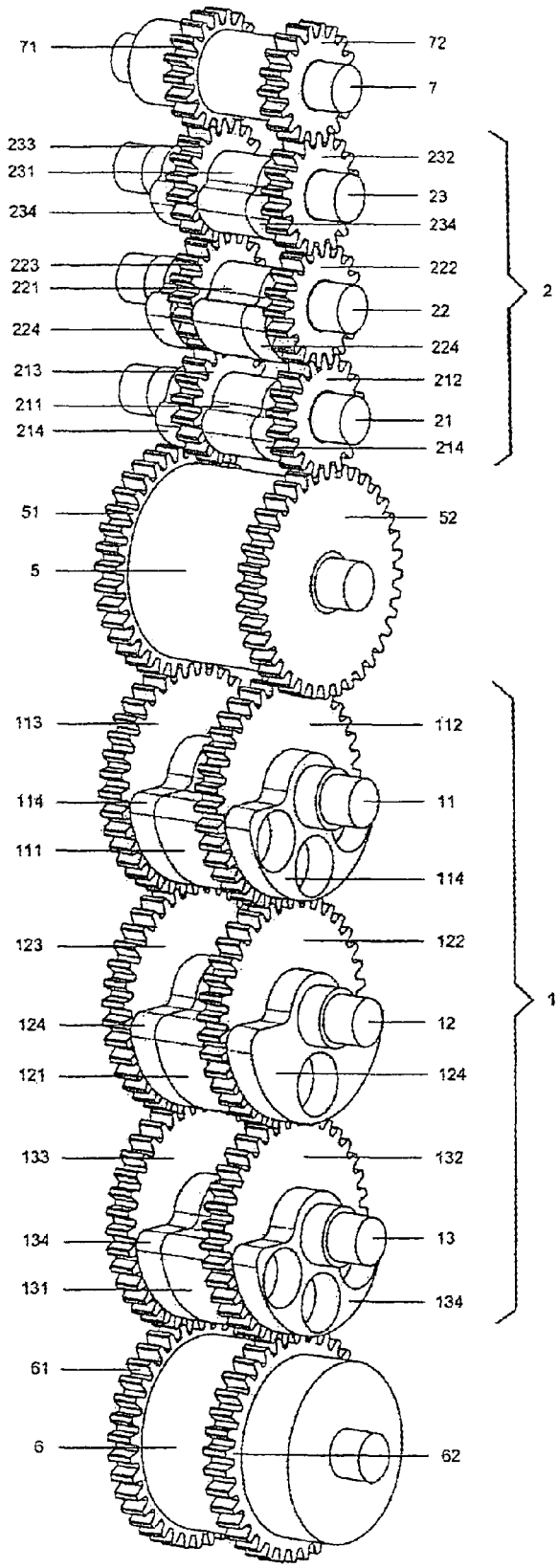
FIG. 1 is a schematic representation of a six-shaft direction-switchable vibrator gear mechanism having a directional effect, with an adjustable static moment.

In the exemplary embodiment according to FIG. 1, two shaft groups 1, 2 each having three shafts 11, 12, 13, 21, 22, 23 are disposed, which are each provided with two gear wheels 112, 113, 122, 123, 132, 133, 212, 213, 222, 223, 232, 233, on which in turn imbalance masses 111, 114, 121, 124, 131, 134, 211 214, 221, 224, 231, 234, are disposed. The number of shafts of the shaft groups 1, 2 can also be selected to be different. A swivel motor 5 is disposed between the shaft groups 1, 2, in such a manner that gear wheel 51 of the housing (stator) of the swivel motor 5 is in engagement with gear wheel 113, and gear wheel 52 of the shaft (rotor) of swivel motor 5 is in engagement with gear wheel 212. Setting of a phase shift of shaft group 2 relative to shaft group 1 is now made possible by means of a relative pivoting of the rotor relative to the stator, thereby making it possible to change the direction of effect. In the exemplary embodiment, swivel motor 5 is a rotary vane swivel motor having three vanes.

In addition, gear wheel 132 of shaft group 1 is in engagement with gear wheel 62 of the rotor of another swivel motor 6, and gear wheel 133 of the shafts of shaft group 1 is in engagement with gear wheel 61 of the stator of swivel motor 6. In the same manner, another swivel motor 7, with its gear wheels 71, 72, is in engagement with gear wheels 232, 233 of shaft 23 of shaft group 2. Setting of the static moment of shaft groups 1, 2 is additionally made possible by means of swivel motors 6, 7. Thus, a "fully adjustable vibrator" is brought about. This consists fundamentally of two adjustable vibrators, in which the static moment can be adjusted independent of one another, and in which the phase position of the two shaft groups can be displaced as desired, with regard to one another, by way of center swivel motor 5. The construction length of this vibrator gear mechanism can be structured to be shorter by means of an offset arrangement of the smaller shafts 21, 22, 23 of shaft group 2.

Figure 5:
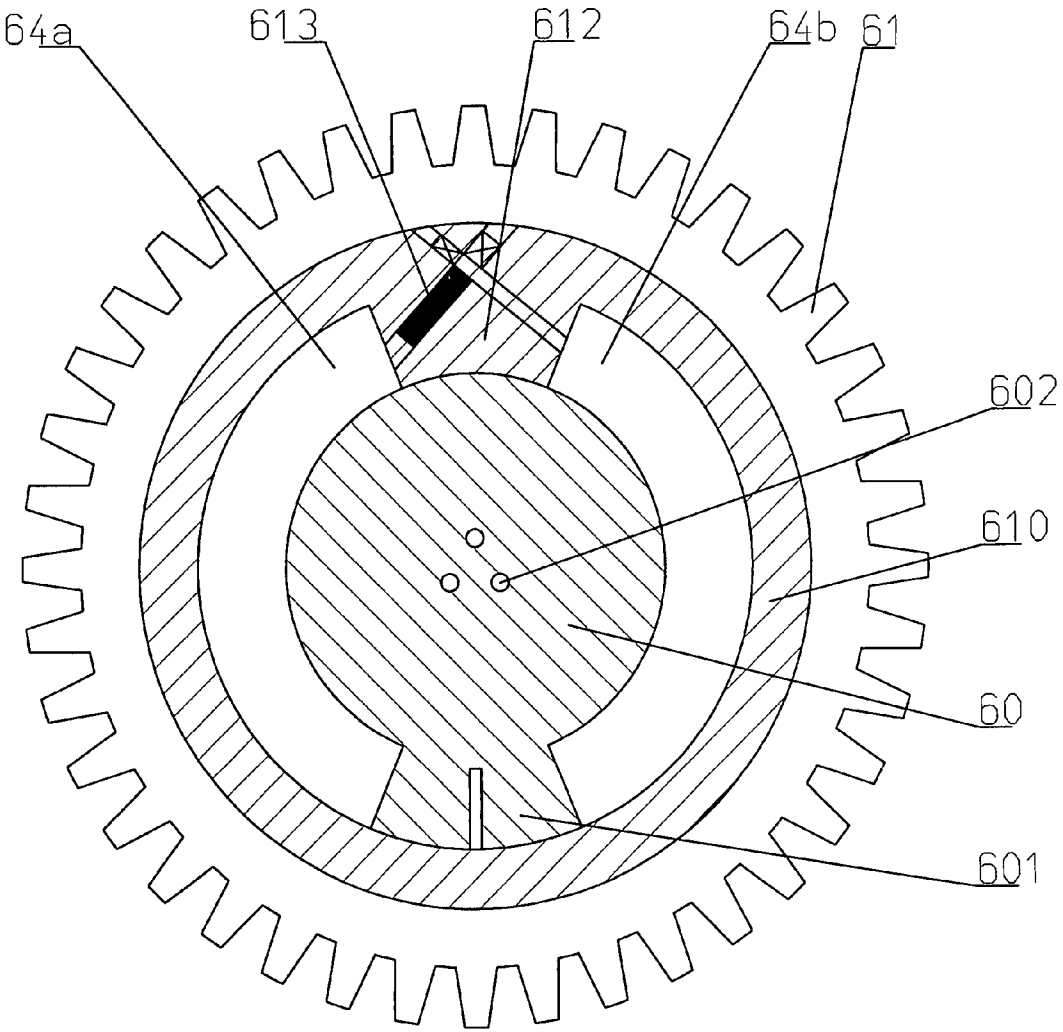
FIG. 5 is a representation of the swivel motor from FIG. 4 in cross-section along the line V-V.

Swivel motor 6—just like the swivel motors 5 and 7—is substantially formed by a swivel motor shaft 60 and a swivel motor housing 610 that surrounds the latter, onto which housing a gear wheel 61 is formed, along with two closure lids 63 disposed on both sides of the swivel motor housing. An interstice is formed between swivel motor shaft 60 and swivel motor housing 610, which interstice is subdivided by a rotor vane 601 formed onto swivel motor shaft 60 and by a stator vane 612 formed onto swivel motor housing 610, so that two working chambers 64*a*, 64*b* are formed. In the exemplary embodiment, stator vane 612 is formed directly onto the inside of gear wheel 61, so that swivel motor housing 610 with gear wheel 61 and stator vane 612 is configured in one piece. To implement a pressure-dependent bias force of the inner seals of swivel motor 6, a change-over valve 613 is disposed in stator vane 612, the control channels of which valve open into working chambers 64*a*, 64*b* on both sides of the stator vane (see FIG. 5). Furthermore, channels 602 for supplying media to the working chambers and to multi-disk brake 65 by means of the hydraulic system are worked in along shaft 60. In addition to the swivel motor, a gear wheel 62 is furthermore disposed on swivel motor shaft 60.

Figure 4:
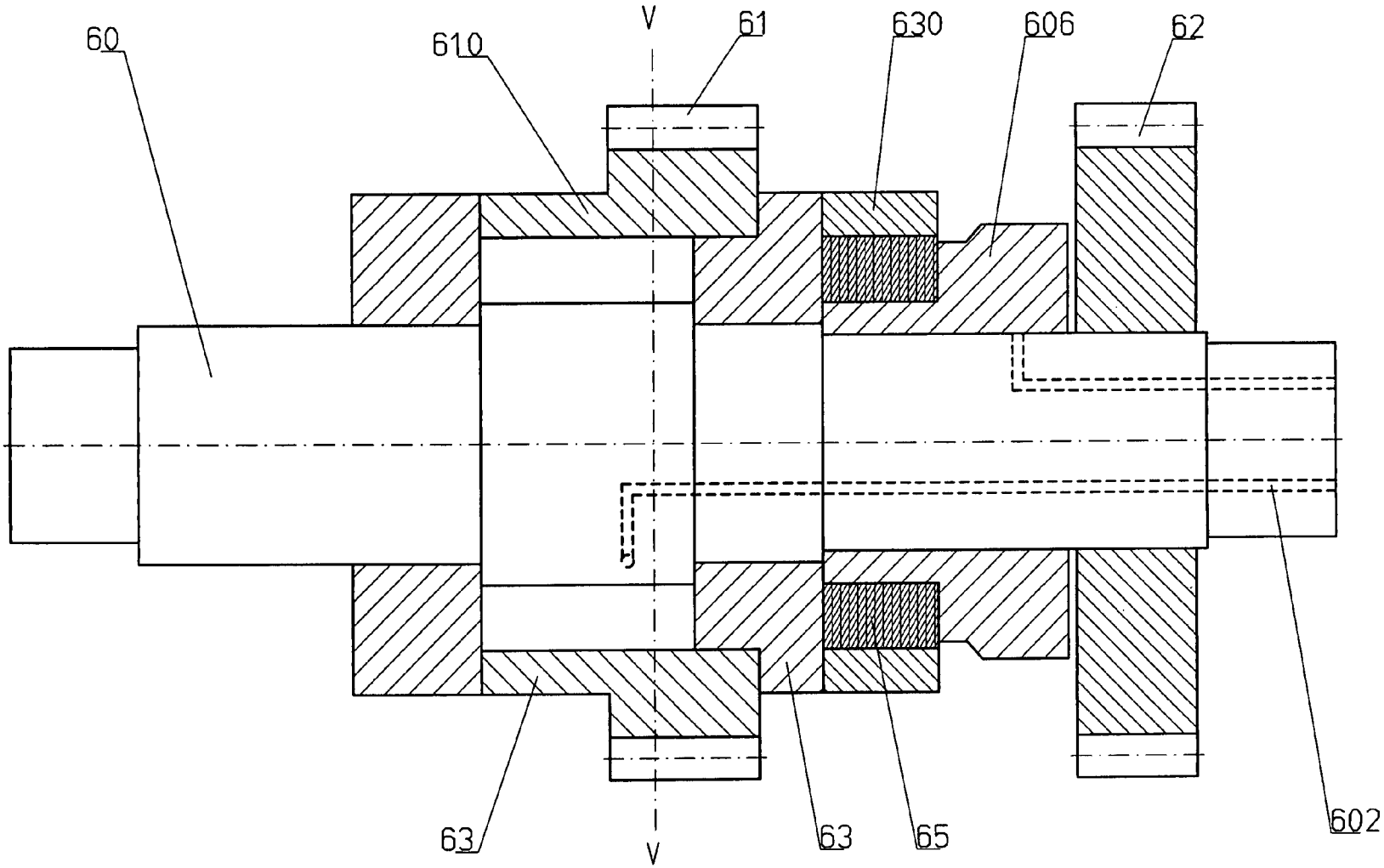
FIG. 4 is a representation of a rotary vane swivel motor in section.

In the exemplary embodiment according to FIG. 4, the swivel motor is provided with a multi-disk brake 65. Multi-disk brake 65 consists of a housing 630 disposed on lid 63 of swivel motor housing 610, a hub 606 attached to shaft 60, and a clutch disk package 65. If the clutch disks that mesh with the housing 630 are mechanically (or alternatively, hydraulically) pressed against the clutch disks that mesh with the hub connected with the swivel motor shaft 60, locking of swivel motor housing 610 in place with swivel motor shaft 60 is brought about.

If one of working chambers 64*a*, 64*b* has excess pressure applied to it, regulated by way of an external directional valve, gear wheel 61 is rotated relative to swivel motor shaft 60 and thus also relative to gear wheel 62, which is connected with swivel motor shaft 60 so as to rotate with it.

Likewise, gear wheels 133, 123, 113 that are in engagement with gear wheel 61 of swivel motor housing 610 are changed in their rotational position, so that imbalance masses 134, 124, 114 of one imbalance group are rotated with regard to imbalance masses 131, 121, 111 of the opposite imbalance group, thereby bringing about a change in the resulting imbalance.

Figure 2A:
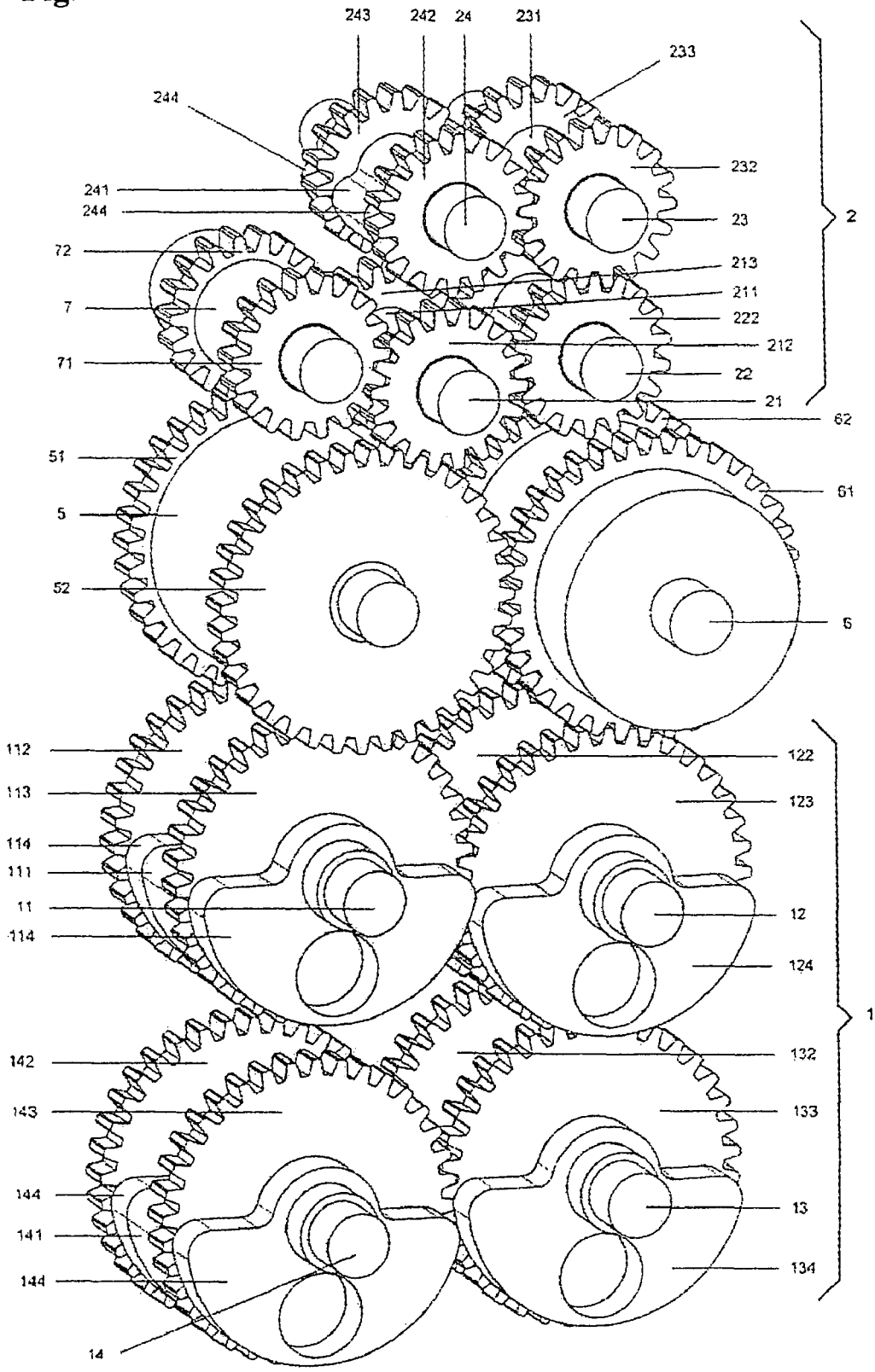
FIG. 2*a* is a representation of the vibrator gear mechanism from FIG. 1 in a compact construction viewed from the front.
Figure 2B:
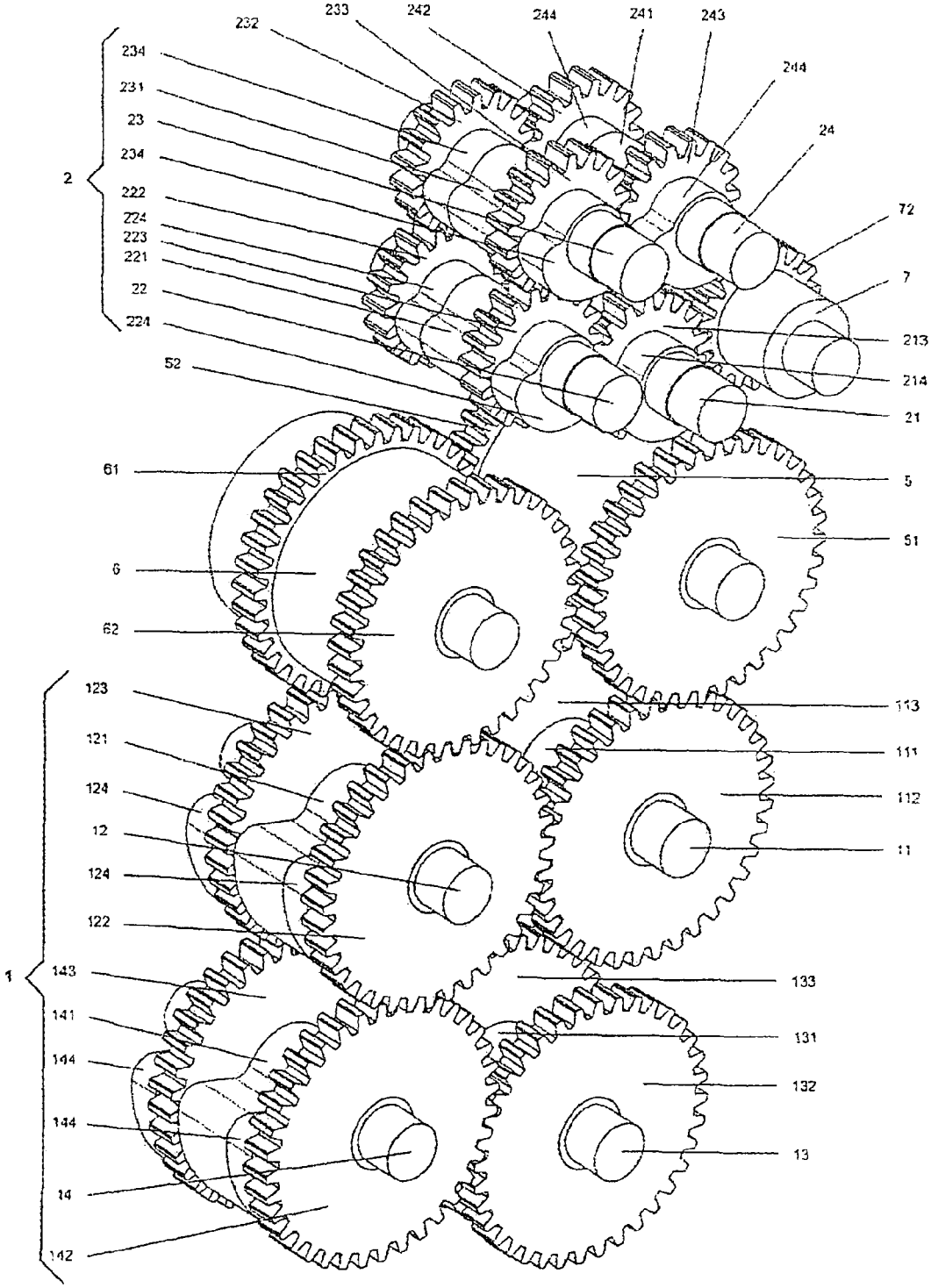
FIG. 2*b* is a representation of the vibrator gear mechanism from FIG. 1 in a compact construction viewed from the back.

In FIG. 2, a modified structure of the above arrangement of the shaft groups (with swivel motors 5, 6, 7) is shown, which permits a clear reduction in the construction length, but in which eight shafts are required in place of six shafts; this, however, results in less stress on the shaft bearings, and brings with it advantages with regard to the centrifugal force that can be achieved, the suitability for high speeds of rotation, and less sensitivity to great angular accelerations.

Figure 3:
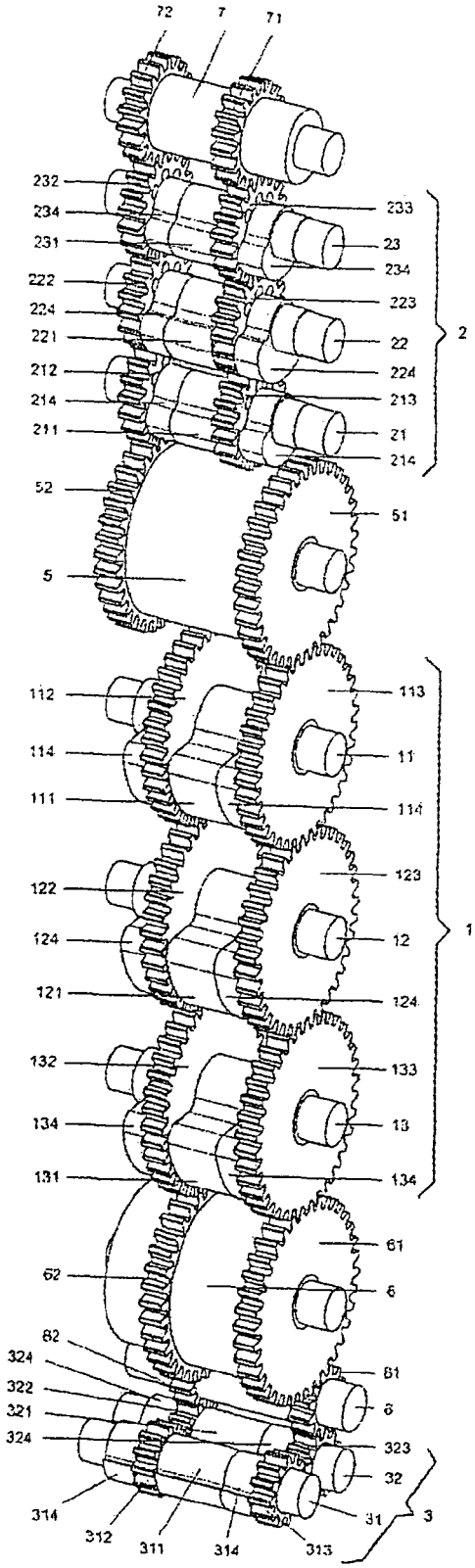
FIG. 3 is a schematic representation of a direction-switchable vibrator gear mechanism with eight shafts.

In order to achieve the most balanced characteristic line shape, an additional speed of rotation stage, whose imbalances rotate at three times the speed of rotation, can be used. The exemplary embodiment according to FIG. 3 shows such an arrangement. Adjustment of the direction of effect takes place by means of swivel motor 5, which adjusts shaft group 2 with regard to shaft group 1, which is coupled with shaft group 3. In the adjustment of the direction of effect, the angular position of shaft group 1 and shaft group 3 relative to one another remains unchanged. Adjustment of shaft group 2 with regard to the others is made possible by means of swivel motor 5.

Swivel motor 6 serves to adjust the resulting imbalance of shaft group 1 by changing the relative position of the first imbalance group formed by imbalances 111, 121, 131, with regard to the second imbalance group formed by imbalances 114, 124, 134. Likewise, swivel motor 7 serves to adjust the resulting imbalance of shaft group 2, and swivel motor 8 serves to adjust the resulting imbalance of shaft group 3.

In the embodiment according to FIG. 3, the ratio of the speeds of rotation of shaft groups 1, 2, 3 with regard to one another amounts to 1:2:3; the static moment of the shaft groups 1, 2, 3 with regard to one another amounts to substantially 10016.64:3.68.

Accordingly, while only a few embodiments of the present invention have been shown and described, it is obvious that many changes and modifications may be made thereunto without departing from the spirit and scope of the invention.

What is claimed is:

1. A vibration generator, comprising:

at least two shaft groups;

at least two imbalance groups disposed on said at least two shaft groups;

at least one drive connected to the at least two shaft groups for rotating the at least two shaft groups, wherein the at least two shaft groups are connected with the at least one drive in such a manner that a speed of rotation of at least one of the at least two shaft groups amounts to a multiple of a speed of rotation of at least one other of the at least two shaft groups, and wherein at least two of the shaft groups demonstrate a different static moment with regard to one another; and at least one phase shifter connected to at least one of the shaft groups, said phase shifter being adapted to adjust a static moment of the at least one shaft group.

2. The vibration generator according to claim 1, wherein the at least one phase shifter is formed by a swivel motor.

3. The vibration generator according to claim 2, wherein the swivel motor is a rotary vane swivel motor, having a swivel motor shaft and a swivel motor housing, wherein both the swivel motor shaft and the swivel motor housing are connected with imbalances on at least one of the shaft groups, and wherein a rotational position of the swivel motor housing relative to the swivel motor shaft can be changed.

4. The vibration generator according to claim 2, wherein the swivel motor has means for locking the swivel motor housing in place with the swivel motor shaft.

5. The vibration generator according to claim 4, wherein the means for locking the swivel motor housing in place with the swivel motor shaft is hydraulically activated.

6. The vibration generator according to claim 4, wherein the means for locking the swivel motor housing in place with the swivel motor shaft is formed by a spring-pressure multi-disk brake.

7. The vibration generator according to claim 1, wherein there are two shaft groups on which the at least two imbalance groups are disposed, wherein the two shaft groups are connected with the at least one drive in such a manner that the speed of rotation of a first one of the shaft groups amounts to half the speed of rotation of a second one of the shaft groups, and wherein a ratio of static moments of the two shaft groups provided with the imbalance groups amounts to approximately between six to one and ten to one.

8. The vibration generator according to claim 7, wherein the static moment of the first shaft group is eight times as great as the static moment of the second shaft group.

9. The vibration generator according to claim 1, wherein there are three shaft groups, on which at least three imbalance groups are disposed, wherein the three shaft groups are connected with the at least one drive in such a manner that the speed of rotation of a first one of the three shaft groups amounts to half the speed of rotation of a second one of the three shaft groups and a third of the speed of rotation of a third one of the three shaft groups, and wherein the ratio of the static moments of the three shaft groups, relative to one another, amounts to substantially 100:16.64:3.68.

10. The vibration generator according to claim 1, wherein there are four shaft groups on which at least four imbalance groups are disposed, wherein the four shaft groups are connected with the at least one drive in such a manner that the ratio of the speeds of rotation of the four shaft groups, relative to one another, amounts to substantially 1:2:3:4, and wherein the ratio of static moments of the four shaft groups provided with imbalance groups, relative to one another, amounts to substantially 100:18.72:5.6:1.38.

11. The vibration generator according to claim 1, further comprising means for adjusting a direction of effect of the vibration generator.

12. The vibration generator according to claim 11, wherein the means for adjusting the direction of effect comprises a second phase shifter that is adapted to change a relative position of at least two of the shaft groups relative to one another.

13. The vibration generator according to claim 12, wherein the second phase shifter is configured as a swivel motor.

14. The vibration generator according to claim 13, wherein the at least two shaft groups are connected with the swivel motor by way of gear wheels, and wherein one shaft group is connected with a stator of the swivel motor and one of the at least two imbalance groups is connected with a rotor of the swivel motor.

* * * * *